US006030121A

United States Patent [19]

Strzyinski et al.

[11] Patent Number: 6,030,121

[45] Date of Patent: Feb. 29, 2000

[54] CONVERTIBLE DISPLAY AND TOTE MEMBER

[76] Inventors: Sandra J. Strzyinski, 6185 Thistle Dr., Saginaw, Mich. 48603; Cathy L. Strzyinski, 1182 Tanglewood Dr., Hemlock, Mich. 48626

[21] Appl. No.: 09/108,326

[22] Filed: Jul. 6, 1998

[51] Int. Cl.[7] ..... B65D 30/22

[52] U.S. Cl. ..... 383/39; 383/22; 383/119

[58] Field of Search ..... 383/38, 39, 4, 383/119, 22, 18; 206/6.1, 745, 756; 150/112, 113, 116; 190/109, 110; 229/67.1, 67.2

[56] References Cited

U.S. PATENT DOCUMENTS

| | | | |
|---|---|---|---|
| 770,354 | 9/1904 | Corfman . | |
| 962,595 | 6/1910 | Smith | 383/22 X |
| 1,586,147 | 5/1926 | Flory . | |
| 1,988,530 | 1/1935 | Wheary | 190/109 X |
| 2,322,688 | 6/1943 | Glick . | |
| 2,674,288 | 4/1954 | Laidlaw | 383/39 X |
| 2,697,465 | 12/1954 | Johnson . | |
| 3,029,852 | 4/1962 | Taylor | 383/22 X |
| 3,139,133 | 6/1964 | Spector . | |
| 3,967,666 | 7/1976 | Farrar . | |
| 3,994,372 | 11/1976 | Geller et al. | 383/18 X |
| 4,753,329 | 6/1988 | Choy | 383/39 X |
| 4,895,198 | 1/1990 | Samuelson . | |
| 4,947,987 | 8/1990 | Keenan . | |
| 4,958,727 | 9/1990 | Bergeron | 206/6.1 |
| 4,960,204 | 10/1990 | Young et al. | 383/39 X |
| 4,967,986 | 11/1990 | Schildkraut | 383/39 X |
| 4,970,821 | 11/1990 | Young | 150/113 X |
| 5,025,918 | 6/1991 | Bergeron | 383/39 X |
| 5,332,093 | 7/1994 | Littlepage . | |
| 5,472,280 | 12/1995 | Rittmaster . | |
| 5,897,209 | 4/1999 | Roegner | 383/39 |

*Primary Examiner*—Jes F. Pascua
*Attorney, Agent, or Firm*—John J. Swartz

[57] ABSTRACT

A convertible display member and tote bag for selectively displaying and transporting articles, such as dolls, comprising a display panel having a plurality of pockets on one side thereof for displaying the articles when the panel is vertically disposed in a planar configuration. The panel is constructed of flaccid material which can be rolled into a rolled, spiral configuration for stowing and transporting articles. A pair of handles are coupled to the panel for vertically supporting the panel in the planar configuration and for enveloping and carrying the panel in the rolled, spiral configuration.

38 Claims, 3 Drawing Sheets

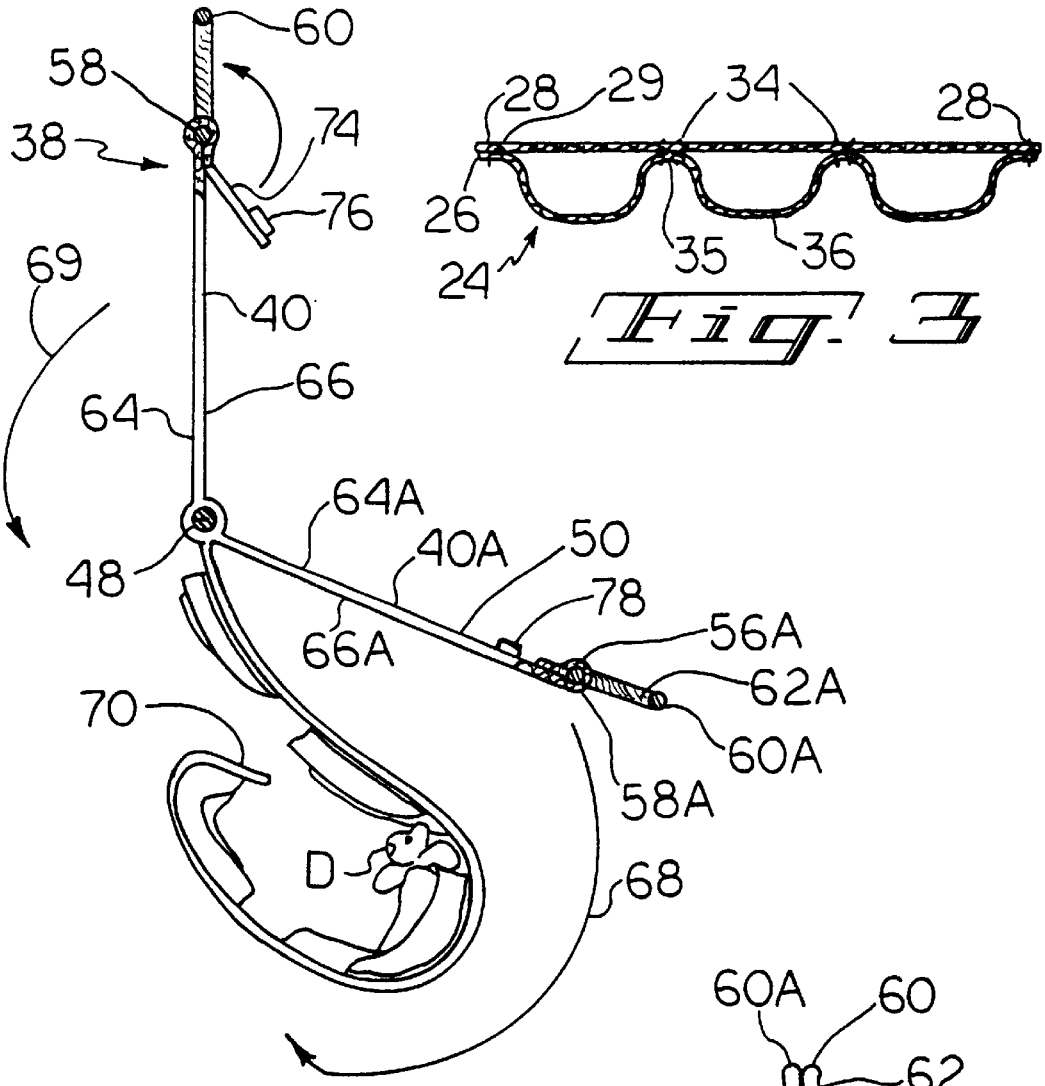
Fig. 3
Fig. 4
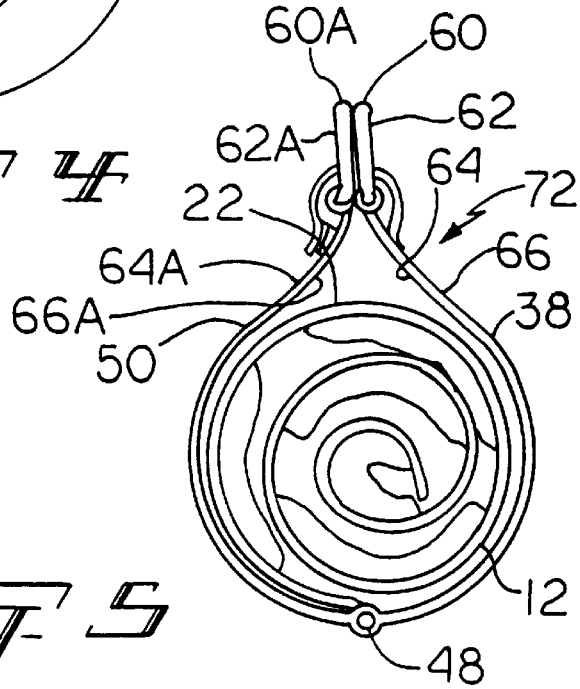
Fig. 5

CONVERTIBLE DISPLAY AND TOTE MEMBER

BACKGROUND OF THE INVENTION

1. Field of the Invention

This invention relates to a convertible display and tote member which can be alternately selectively configured in an unfolded, draped configuration for hanging on a wall to display a plurality of articles, such as dolls, and alternately folded into a folded configuration for storing and transporting the articles.

2. Description of the Prior Art and Objects

In recent years, the collection of dolls has become a craze among a wide cross-section of consumers. It is not at all unusual for a doll collector to have a dozen or more dolls of a single family such as those sold under the trademark "BEANIE BABIES".

Collectors are typically proud of their collections and thus, it is common for a collector to display the dolls, in the collector's bedroom, for example. If a child collector wants to transport the dolls to another location, the transport of such a large number of dolls can become cumbersome, time consuming. Accordingly, it is an object of the present invention to provide new and novel apparatus for storing, displaying, and transporting a plurality of articles, such as dolls.

Another object of the present invention is to provide a new and novel device for storing articles, such as dolls, on a panel which can be easily folded from an unfolded, draped configuration for displaying articles to a folded configuration for transport.

It is another object of the present invention to provide a new and novel apparatus for storing articles including a plurality of individual pockets into which the articles can be stowed on a flexible sheet that is rollable into a spiral that can be easily transported.

Several patents, such as U.S. Pat. No. 770,354 issued to W. Corfman on Sep. 20, 1904, U.S. Pat. No. 2,697,465 issued to G. P. Johnson on Dec. 21, 1954, U.S. Pat. No. 4,947,987 issued to Kathleen C. Keenan on Aug. 14, 1990, U.S. Pat. No. 3,139,133 issued to L. Spector on Jun. 30, 1964, U.S. Pat. No. 3,967,666 issued to Sophia M. Farrar on Jul. 6, 1976, disclose the broad concept of a sheet or apron having a plurality of rows of pockets into which products, such as mail or clothing articles, are stored. None of the patents disclose the concept of folding or rolling the transport device into a spiral and converting the holder into a tote for transporting articles, such as dolls. Accordingly, it is another object of the present invention to provide new and novel convertible display panel and tote apparatus which is converted from a planar, article displaying configuration to a rolled spiral, configuration for transport.

Another prior art storage device is illustrated in U.S. Pat. No. 5,472,280 issued to Peter A. Rittmasteron Dec. 5, 1995. The Rittmaster patent discloses a bag which is deposited into a purse when not in use. In the Rittmaster device, it can be difficult for a child to manipulate a bag carrying articles into and out of the purse opening. Accordingly, it is an object of the present invention to provide an article display and tote member which can be easily converted between an article display configuration and a folded tote configuration.

It has been found according to the present invention that the aforementioned article carrying panel, which has been folded or rolled into a spiral, can be quickly and easily transported to a tote device by the use of a pair of flexible handles which are coupled to one end of the article supporting panel and moved from panel supporting positions in which at least one of the handles is generally lying in the plane of the panel to tote positions enveloping the rolled panel with the handle members in abutting juxtaposed positions. Accordingly, it is a further object of the present invention to provide a new and novel convertible display and tote apparatus of the type described including new and novel handle mechanism for vertically supporting the panel and alternately for carrying the panel in a rolled spiral position.

It is another object of the present invention to provide article display and tote member of the type described including a pair of flaccid handles which are coupled to one end of a display sheet which can be disposed in a freely draped configuration so that at least one of the handles is alternately disposed in the plane of the sheet vertically supporting the sheet and a curvilinear position underlying the sheet which is disposed in a folded configuration.

It is yet another object of the present invention to provide a convertible display and tote member of the type described which includes a rigidifying member for rigidifying the article supporting panel to prevent it from collapsing while it is supported vertically in a planar position.

It is still another object to provide a convertible display and tote member of the type described including two flaccid handles alternately displaceable in generally parallel sheet hanging positions and curvilinear positions extending in opposite directions around the underside of the article support sheet in a rolled spiral configuration.

It is a further object of the present invention to provide a display and tote member of the type described including two handles, each having front and back sides, alternately disposable in sheet hanging positions in which the at the front side of one handle confronts the back side of the other handle and sheet tote positions in which the back side of the one handle confronts the front side of the other handle.

It is a still further object of the present invention to provide a convertible tote and display member having a double handle of the type described wherein one of the handles is disposed in the plane of the panel when the panel is in the display configuration and the other handle functions as a curtain to cover articles disposed in the panel supported pockets.

Other objects and advantages of the present invention will become apparent to those of ordinary skill in the art as the description thereof proceeds.

SUMMARY OF THE INVENTION

A convertible display member and tote member for selectively displaying and transporting articles comprising: an article support sheet for supporting a plurality of articles and being convertible between a generally upstanding draped configuration for displaying articles and a folded configuration for storing and transporting articles: and handle mechanism coupled to the sheet support member for vertically supporting the article sheet support member in the upstanding, draped configuration and for carrying the sheet support member in the folded configuration.

DESCRIPTION OF THE DRAWINGS

The invention may be more readily understood by referring to the accompanying drawings, in which:

FIG. 3 is a sectional plan view thereof, taken along the section line 3—3 of FIG. 1;

FIG. 4 is a side elevational view illustrating the rolling movement of the free end of the draped panel as it is being converted from the unfolded draped position illustrated in FIGS. 1 and 2 to the folded spiral tote configuration illustrated in FIG. 5, part of the handle being broken away in section for purposes of clarity;

FIG. 5 is an end elevational view illustrating the convertible display end tote member constructed according to the present invention rolled into the spiral toting position which the handles wrap around the sheet and articles stored therein;

DESCRIPTION OF PREFERRED EMBODIMENT

Figure 6:
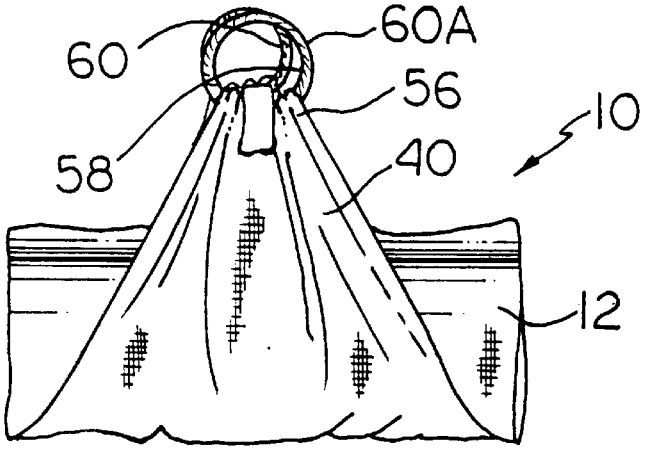
FIG. 6 is a front side elevational view of the convertible display and tote member in the spiral tote configuration illustrated in FIG. 5.
Figure 7:
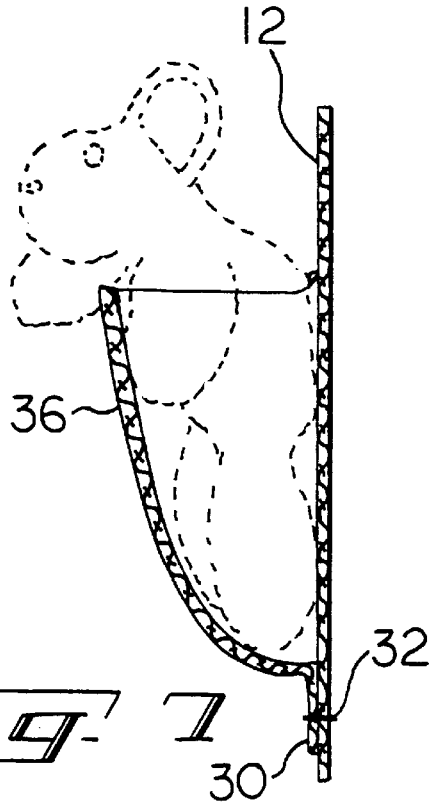
FIG. 7 is a greatly enlarged sectional end view of one of the article supporting pockets having an article, such as a doll illustrated therein in chain lines, taken along the section line 7—7 of FIG. 1.
Figure 8:
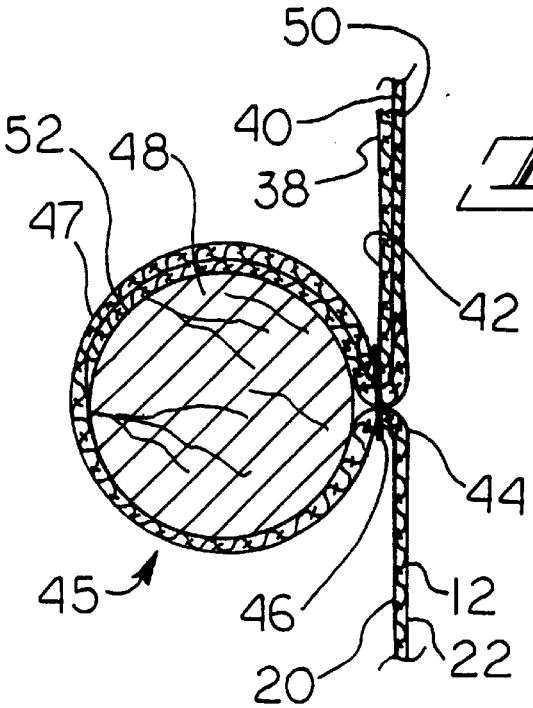
FIG. 8 is a greatly enlarged sectional end view more particularly illustrating the junction of the handles and the article supporting panel, and a rigidifying rod at the junction, taken along the section line 8—8 of FIG. 1.

A convertible display and tote member constructed according to the present invention, generally designated 10, includes an article support sheet or panel, generally designated 12, and a handle assembly, generally designated 14. The panel 10 can be converted between a display configuration illustrated in FIGS. 1 and 2 and a tote configuration illustrated in FIGS. 5 and 6. The panel 12 may suitably comprise a flaccid sheet of foldable fabric, such as cloth, having a predetermined width 16 and a predetermined height 18. When vertically hung or draped in an upstanding unfoldable display position, illustrated in FIGS. 1 and 2, the panel 12 lies in a vertical plane 19. The sheet 12 includes front and rear surfaces or sides 20 and 22, respectively.

Mounted on the front surface or display face 20 is a plurality of vertically spaced bands or strips 24 of flexible material, such as cloth. The bands 24 each have opposite ends 26 stitched or otherwise suitably secured to the lateral edges 28 of the sheet 12 at 29 and a bottom edge 30 stitched at 32 to the front face 20 of the sheet 12. A plurality of laterally spaced apart vertical stitch rows 34 couple laterally spaced portions 35 of the band 34 to the panel 12 to divide the band 24 into a plurality of laterally spaced apart upwardly opening pockets 36 into which one or more articles, such as dolls D are disposed.

The handle assembly 14 includes first and second flaccid handles 38 and 50. The handle 38 includes a flaccid sheet of fabric 40 which is integral with, and a continuation of, the panel 12 and includes a lower portion 42 joined to the upper portion 44 of the panel 12 via stitching, generally designated 46. The juncture 45 of the sheets 40 and 12 includes an integral cylindrically shaped coupling sheet portion 47 which snugly receives a laterally extending rigidifying dowell rod 48 that spans the laterally opposite edge portions 28 of the sheet 12.

The first sheet handle 40 includes lateral edge portions 52 and 54 which converge upwardly in a direction away from the article supporting panel 12 and the rigidifying dowel rod 48. The handle edges 52 and 54 are disposed laterally inwardly of the lateral panel edges 26. The upper end 56 of the handle sheet 40 includes is gathered and folded on itself as illustrated to provide a curvilinear, tubular recess 58 that receives the lower end of a rigid, circular, hand graspable hand grip 60. The hand grip 60 includes a hand receiving recessor opening 62 into which a user's hand may be received or the recess 62 may be mounted on a suitable mounting bracket on a wall for displaying the panel 12. The sheet 40 of the first handle 40 includes front and rear sides 64 and 66, respectively.

The handle assembly 14 includes a second flaccid handle 50 which is similarly configured to the handle 38, except that it is not integral with the panel 12, and generally similar parts will be identified by similar reference characters followed by the letter A subscript. The handle 50 has a lower terminal end 52 which is sandwiched between the cylindrically shaped sheet portion 47 and the dowel rod 48 and is coupled to the handle 40 and the panel 12 via the stitching 46.

The second handle 50 includes a handle sheet 40A and a rigid hand grip 60A having an opening 62A therein identical to the rigid grip 60. The handle forming sheet 50 can be moved to a wall hanging position, illustrated in FIG. 2 to be substantially parallel to and coextensive with the handle sheet 40. Both handles 38 and 50 can be thus mounted on a wall hanger bracket if needed to support the panel 12 and the articles D supported thereon. The handle sheet 40A includes front and rear sides 64A and 66A. In the position of the handle 14 illustrated in FIG. 2, the front surface or side 64A of sheet 40A is abutting the rear side 66 of the front handle sheet 40.

Figure 1:
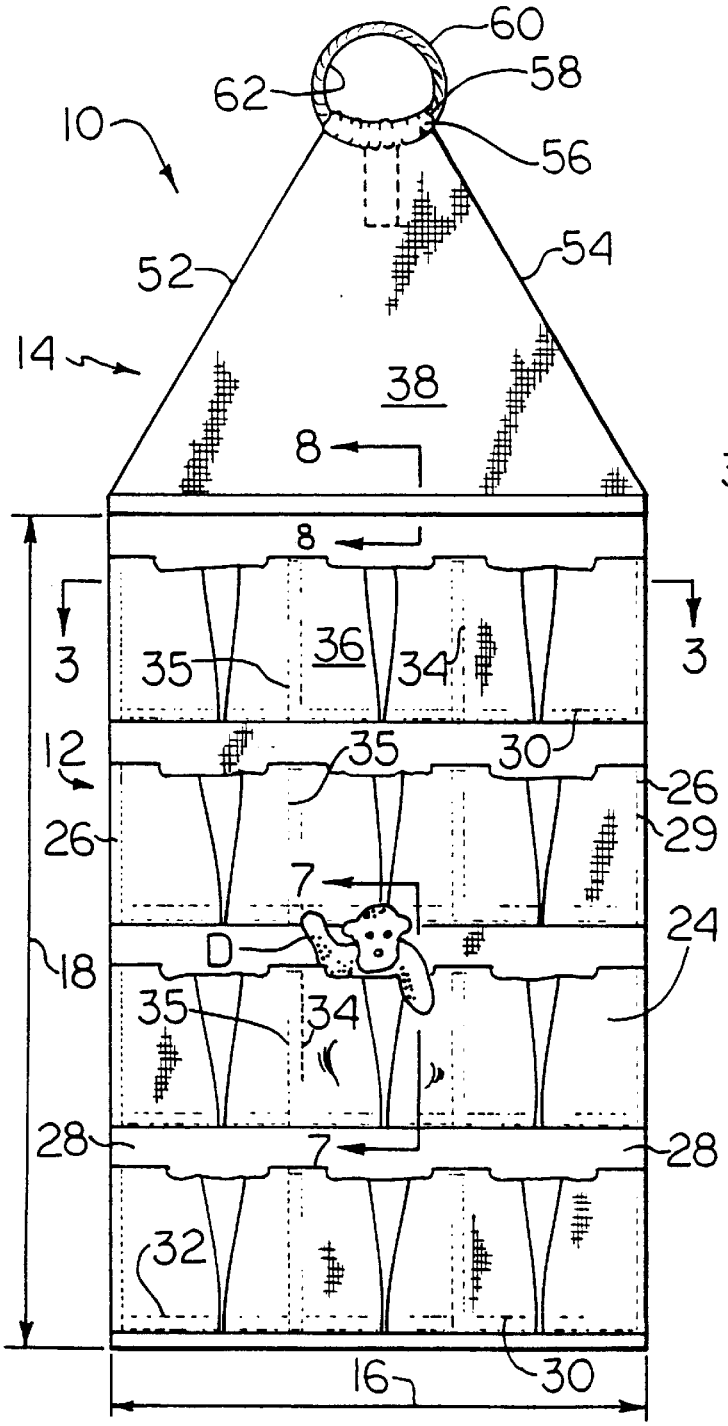
FIG. 1 is a front side elevation view of the convertible display and tote member constructed according to the present invention in an unfolded, upstanding draped or planar position suitable for hanging on a wall.
Figure 2:
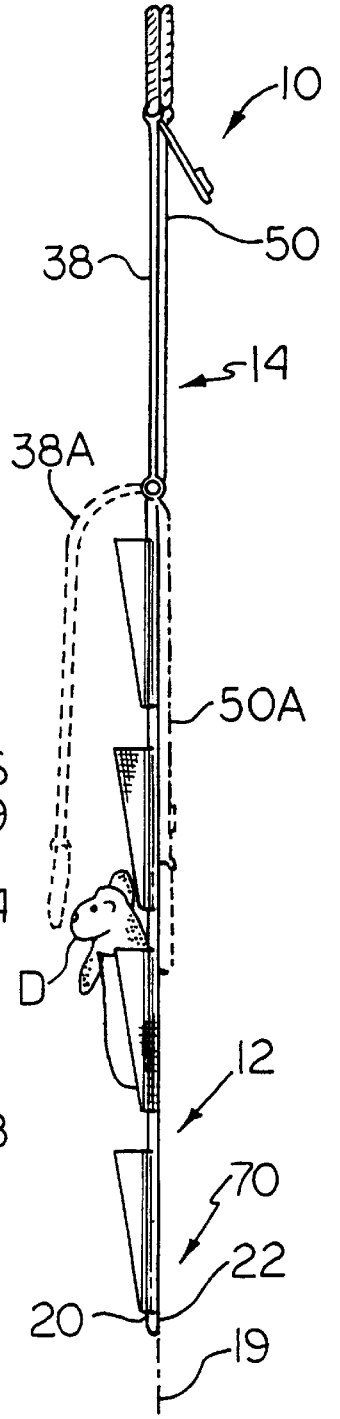
FIG. 2 is a side elevational view thereof, taken from the right side of FIG. 1.

Alternatively, the first handle can be disposed in the plane 19 to solely support the panel 12 and the second handle 50 may be allowed to hang downwardly to a rearwardly draped position, illustrated in chain lines at 50A in FIG. 2, displaced 180° from the handle 38 so that the back side 66A of sheet 40A is abutting the rear surface 22 of the panel 12 when the article supporting panel 12 is in the vertical display position illustrated in FIGS. 1 and 2.

On the other hand, the second handle 50 may be disposed in the plan 19 and solely used to support the panel 12 while the first handle 38 is converted to a downwardly draped curtain in the position illustrated in chain lines at 38A to selectively cover the articles D supported in the pockets 36.

To convert the apparatus 10 from the upstanding display configuration, illustrated in FIGS. 1 and 2, to the storage and transport or tote position, illustrated in FIG. 5, the suspension panel 12 is folded or rolled in the direction of the arrow 68 (FIG. 4) to move the lower free terminal panel end, generally designated 70, clockwisely in the direction of arrow 68 until the entire panel 12 is rolled to the spiral position, illustrated in FIG. 5, and the pockets 36 and articles D stored therein are enclosed. The handle 50 is likewisely rolled in the direction of the arrow 68 so that the back surface 66A continues to engage the back or exposed side 22 of the panel 12 and then swings upwardly so that the back side 66A of rear handle 50 now confronts the front side 64 of the sheet handle 40. The handle 38 is concurrently rolled or folded relative to panel 12 in the opposite direction, represented by the arrow 69, to the tote position illustrated in FIG. 5. When moved to the tote or transport position, the dowel rod 48 and sheet end 44 underlie the panel 12 and pockets 36 in the spiral, rolled position illustrated in FIG. 5. The hand grips 60 and 60A are now abutting and disposed parallel to each other.

A fastener, generally designated 72, is provided for detachably securing the handles 38 and 50 in the tote positions illustrated in FIG. 5 and includes a snap fastener 74 comprising a sheet of fastening material, having a layer of fastening material distributed under the trademark VELCRO fixed to one side 66 of sheet 40, for engaging a complementally formed sheet 78 of fastening material on the side 64A of sheet 40A, 50 when the handles 38 and 50 are in the tote positions illustrated in FIG. 5.

The fastener sheet 74 is selectively moved from the unlatching position illustrated in FIG. 4 to the latching position illustrated in FIG. 5 to detachably secure the handles 60 and 60A together.

The Operation

The convertible display and tote member 10 is initially disposed on a wall hanger (not shown) via both of the handles 60 and 60A disposed in the abutting positions, illustrated in FIG. 2, so that the panel 12 is suspended in a spread unfolded, draped, upstanding position, lying in a vertical plane 19, as illustrated in FIG. 2. The user will place articles, such as dolls D, in selected exposed pockets 36 for display and observation. If the user wants to temporarily cover the dolls D while the panel 12 remains in the planar configuration, only the rear handle 50 will be disposed in the plane 19 while the first handle 38 is removed from the wall hanger and allowed to drape downwardly to form a curtain over the front side 20 of panel 12 to cover the pockets 50. For example, a user might want to dramatically present the dolls by initially covering them with a curtain in the form of draped panel 38A and then suddenly raise the curtain by returning the panel 38 to the position illustrated in FIG. 2. The user may also want to temporarily drape the panel 38 in the position illustrated at 38A as a dust cover.

When the user wants to move the articles D to another location, the user will fold or roll the lower end 70 of panel 12 in a clockwise direction, represented by the arrow 68, to the folded, spiral position, illustrated in FIG. 5, in which the pockets 36 and articles D stored therein are enclosed. The handle 50 is likewisely swung in a clockwise direction, represented by the arrow 68, from the wall hanging position, illustrated in FIG. 2 to the tote position, illustrated in FIG. 5. The handles 38 and 50 including rigid hand grips 60 and 60A will operate as a handle for carrying the spiral panel 12 and the articles D supported thereon.

The fastener 76 is then attached to the cooperating fastener strip 78 to hold the hand grips 60, 60A and handles 38, 50 together.

When the user has transported the dolls D to the new destination, the fastener strap 76 is detached and the handle 50 is swung in an opposite counter clockwise direction, to the position illustrated in FIG. 2 whereby the panel 12 can unwind in a counter clockwise direction and be again disposed in a vertical position so that the dolls D can again be displayed.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What we claim is:

1. A convertible display and tote member for selectively displaying and transporting articles comprising:

a suspension panel having first and second opposite faces;

support means on said first face for supporting a plurality of articles in spaced apart relation on said panel;

said panel being convertible between a spread, unfolded, draped configuration in which said support means, and said articles supported therein, are exposed and a folded configuration in which said support means and said articles stored therein are enclosed for stowing and transporting articles;

a first handle having a coupling portion coupled to one end of said panel for vertically supporting said panel in said unfolded draped configuration and for bearing against said second face to hold and support said panel in said folded draped configuration, and a terminal, hand graspable end portion; and a second handle having a coupling portion coupled to said one end of said panel and bearing against said second face and including a hand graspable terminal end portion disposed in confronting relation with said terminal hand graspable end portion of said first handle to hold and support said panel is in said folded configuration.

2. The convertible display and tote member as set forth in claim 1 wherein said suspension panel has a predetermined length and width, said support means comprises a plurality of laterally extending bands longitudinally spaced along the length of said suspension panel, each of said bands including a plurality of laterally spaced article receiving pockets therein.

3. The convertible display and tote member set forth in claim 1 wherein said panel has first and second longitudinally spaced ends and lateral edges spanning said ends, and including a rigidifying bar coupled to said one end of said panel to inhibit said lateral edges of said panel from laterally inwardly collapsing when said panel is vertically disposed in said unfolded, draped configuration.

4. The convertible display and tote member set forth in claim 3 wherein said rigidifying bar underlies said panel in said folded configuration.

5. The convertible display and tote member set forth in claim 1 wherein said panel in said folded configuration forms a rolled spiral, said handles each comprising a sheet of flaccid material.

6. The convertible display and tote member set forth in claim 5 wherein each of said sheets of material has lateral edges which converge in a direction toward said terminal end.

7. Convertible apparatus for selectively displaying a plurality of articles on a wall, or the like, and alternately stowing said articles for transport comprising:

article support means for supporting a plurality of articles including a flaccid apron having a predetermined width and length, and first and second opposed faces, and movable between a generally planar, wall hanging configuration and a folded configuration;

a laterally extending support bar coupled to one end of said apron for dependently supporting said apron in said planar, wall hanging configuration;

a plurality of pockets on said first face of said apron for supporting a plurality of said articles therein;

first and second flexible handle members, each having first and second opposite surfaces, coupled to said support bar and said one end of said apron for movement between generally parallel wall hanging positions in which said first surface of said second flexible handle members confronts said second surface of said first flexible handle member, when said apron is in said planar, wall hanging configuration, and curvilinear apron holding and carrying positions in which said second flexible handle member confronts said first surface of said first flexible handle member when said apron is in said folded position.

8. The convertible apparatus set forth in claim 7 wherein said apron in said folded position forms a rolled spiral, said support bar underlying said apron when said apron is formed into said rolled spiral.

9. A combination tote and display member for storing and transporting a plurality of articles, such as dolls, comprising:

a flaccid sheet of material having a mounting end, a free end, and laterally opposite edge portions longitudinally extending between said ends, a plurality of pockets mounted on one side of said sheet for detachably receiving and storing a plurality of said articles therein;

said free end of said sheet being foldable upon itself toward said mounting end into a folded configuration to enclose said pockets and said articles stored therein but adapted to unfold to a spread, unfolded, draped configuration in which said pockets and said articles disposed therein are exposed;

first and second handles, each having one end coupled to said mounting end, extending in opposite directions around said sheet for holding and carrying said sheet in said folded configuration;

said handles each including opposite ends providing hand grips disposed in confronting relation with each other for releasably holding said sheet in said folded configuration;

said second handle being releasably movable relative to said first handle to allow said free end of said sheet to unfold from said folded configuration to said unfolded, draped configuration;

at least said first handle being adapted to support said sheet on an object, such as a wall hanger, in said unfolded draped configuration to display said articles stored in said pockets.

10. The combination display and tote member set forth in claim 9 including a laterally extending support bar coupled to said mounting end.

11. The combination display and tote member set forth in claim 10 wherein said support bar will underlie said pockets when said sheet is in said folded configuration and overlie said pockets when said sheet is in said unfolded configuration.

12. The combination display and tote member set forth in claim 9 wherein said first and second handles comprise first and second flexible sheets of material, respectively.

13. The combination display and tote member set forth in claim 12 wherein said first and second sheets of material include lateral edges which converge away from said one end coupled to said mounting end in a direction toward said opposite end providing said hand grips.

14. The combination display and tote set forth in claim 9 wherein said free end of said sheet in said folded configuration is rolled into a spiral configuration and said sheet in said unfolded configuration is generally planar.

15. The combination display and tote member set forth in claim 14 wherein said handles are flaccid and are disposed laterally inwardly, of said laterally opposite edge portions.

16. The combination display and tote member set forth in claim 15 wherein said first handle and said sheet of material are integral.

17. The combination display and tote member set forth in claim 16 including a laterally extending support rod mounted on said mounting end of said sheet at the junction of said mounting end of said sheet and said first handle.

18. The combination display and tote member set forth in claim 17 wherein said handles each include first and second sides, said first side of said first handle confronting said second side of said second handle when said handles are holding said sheet in said spiral configuration, said second handle when released, being swingable relative to said first handle to a position on the opposite side of said first handle so that said first side of said second handle confronts said second side of said first handle.

19. The combination display and tote member set forth in claim 9 wherein said mounting end overlies said pockets when said sheet is in said unfolded, draped configuration and underlies said pockets when said sheet is in said folded configuration.

20. The combination display and tote member set forth in claim 19 wherein said one end of said first handle is disposed above said sheet in said unfolded, draped configuration, and below said sheet in said folded configuration.

21. The combination display and tote member set forth in claim 20 wherein said first handle lies in the plane of said sheet in said unfolded configuration; said one end of said first handle bearing against an opposite side of said sheet, opposite said one side when said sheet is in said folded configuration.

22. A convertible display and tote member for selectively displaying and transporting articles comprising:

article support sheet means, having opposite ends, for supporting a plurality of articles and being convertible between a generally planar configuration for displaying said articles and a folded configuration for stowing and transporting said articles; and handle means coupled to one of said opposite ends of said support sheet mean for vertically supporting said article support sheet means in said planar configuration and for holding and carrying said support sheet mean in said folded configuration;

said handle means including first and second handles which are coupled to said one end and pass in opposite directions around said article support sheet means in said folded configuration;

said first and second handles having first and second terminal end portions, respectively, which abut each other when said article support means is in said folded configuration.

23. The convertible display and tote member set forth in claim 22 wherein said first and second handles are convertible between generally planar conditions displaced 180° relative to each other, when said article support sheet means is in said planar configuration, and enveloping positions enveloping said sheet support means in said folded configuration; said first and second handles including terminal end portions disposed in abutting relation when said first and second handles are in said enveloping positions.

24. The convertible display and tote member set forth in claim 23 wherein said first and second handles each include portions which are coupled to said support sheet mean and disposed curvilinearly when said article support sheet means is disposed in said folded configuration.

25. The convertible display and tote member set forth in claim 22 wherein said first and second handles are each movable between a generally planar position when said article support sheet means is in said planar configuration and a curvilinear position when said article support sheet means is in said folded configuration.

26. The convertible display and tote member set forth in claim 25 wherein said first and second handles include coupling ends coupled to said one end of said article support sheet means and opposite terminal end portions disposed in abutting relation in said curvilinear position.

27. The convertible display and tote member set forth in claim 22 wherein said article support sheet means comprises a skirt having first and second sides and a plurality of pockets, open at one end, fixed to said first side of said skirt for receiving and storing a plurality of said articles.

28. The convertible display and tote member set forth in claim 27 wherein said plurality of pockets comprise a plurality of spaced apart bands fixed to said first side of said skirt, each of said bands including said plurality of said pockets.

29. The convertible display and tote member set forth in claim 27 wherein said first and second handles bear against said second side of said skirt when said article support sheet means is in said folded configuration.

30. A convertible display and tote member for selectively displaying and transporting articles comprising:

article support sheet means having first and second sides for supporting a plurality of articles on said first side and being convertible between a generally planar configuration for displaying said articles on said first side and a folded configuration for stowing and transporting said articles; and handle means coupled to said support sheet mean for vertically supporting said article support sheet means in said planar configuration and for holding and carrying said sheet support mean in said folded configuration; and ridifying means coupled to said article support sheet means for rigidifying said sheet means;

said handle means including a first handle having a lower portion coupled to said rigidifying means;

said first handle lying in the plane of said article support sheet means in said planar configuration;

said lower portion of said first handle bearing against said second side of said article support sheet means when said article support sheet means is in said folded configuration.

31. The convertible display and tote member set forth in claim 30 wherein said article support means comprises a skirt having a predetermined width and length and said rigidifying means comprises a rod spanning the width of said skirt.

32. The convertible display and tote member set forth in claim 31 wherein said skirt extends longitudinally and has longitudinally opposite ends and lateral edges, and further including a laterally extending rigidifying bar spanning said lateral edges.

33. The convertible display and tote member set forth in claim 32 wherein said handle means is disposed laterally between said lateral edges.

34. The convertible display and tote member set forth in claim 33 wherein said handle means is coupled to said rigidifying bar.

35. The convertible display and tote member set forth in claim 34 wherein said rigidifying bar underlies said article support sheet support means in said folded configuration.

36. The convertible display and tote member set forth in claim 35 wherein each of said handles comprises a sheet of rollable fabric; each of said sheets of fabric including lateral edges which converge in a direction toward said terminal end; and including keeper means for detachable coupling said handles together when said panel is in said folded configuration.

37. A convertible display and tote member for selectively displaying and transporting articles comprising:

article support sheet means for supporting a plurality of articles and being convertible between a generally planar configuration for displaying said articles and a folded configuration for stowing and transporting said articles; and handle means coupled to said support sheet mean for vertically supporting said article support sheet means in said planar configuration and for holding and carrying said support sheet mean in said folded configuration;

said article support sheet means including a front side on which said articles are supported and a rear side;

said handle means includes first and second handles coupled to one end of said article support sheet means;

said first handle being selectively displaceable between a draped position covering articles supported by said article support sheet means and a panel carrying position in the plane of said article support sheet means when said article support sheet means is in said planar configuration, and a curvilinear carrying and support position when said article support sheet means is in said folded configuration;

said second handle being displaceable between a planar position in the plane of said article support sheet means in said planar configuration and said first handle is in said draped position, a rearwardly downwardly draped position along side said back side when said first handle is in said panel carrying position, and a curvilinear position when said article support sheet means is in said folded configuration.

38. A convertible display and tote member for selectively displaying and transporting articles comprising:

article support sheet means for supporting a plurality of articles and being convertible between a generally planar configuration for displaying said articles and a folded configuration for stowing and transporting said articles; and handle means coupled to said support sheet mean for vertically supporting said article support sheet means in said planar configuration and for holding and carrying said support sheet mean in said folded configuration;

said support sheet mean, in said folded configuration forming a rolled spiral;

said handle means including first and second handles each including first and second surfaces;

said first surface of said second handle being disposed in juxtaposition with said second surface of said first handle when said article support sheet means is in said planar configuration;

said second surface of said second handle being disposed in confronting relation with said first surface of said first handle when said article support sheet means forms said rolled spiral configuration.

* * * * *